United States Patent [19]

Smith

[11] 3,980,326

[45] Sept. 14, 1976

[54] OBSCURELY LATCHED CLOSURES FOR CABINETS

[76] Inventor: Charles V. Smith, 24120 Dunlap Road, Bothell, Wash. 98011

[22] Filed: June 2, 1975

[21] Appl. No.: 583,111

[52] U.S. Cl. ..... 292/86

[51] Int. Cl.[2] ..... E05C 3/10

[58] Field of Search ..... 292/86, 87, 254, 255

[56] References Cited

UNITED STATES PATENTS

| | | | |
|---|---|---|---|
| 1,094,773 | 4/1914 | Beehler | 292/254 X |
| 1,293,347 | 2/1919 | Corwin | 292/87 X |
| 2,106,642 | 1/1938 | Matthews | 292/255 X |
| 2,735,740 | 2/1956 | Soans | 292/254 X |
| 3,801,143 | 4/1974 | Gutner | 292/76 |

*Primary Examiner*—Richard E. Moore

[57] ABSTRACT

A toe-operated, concealed latching mechanism for the front door or doors of storage cabinets, as commonly used in kitchens and bathrooms, has its operative member obscurely located in the kick-space beneath the cabinet at the floor. The arrangement of parts serves to virtually preclude entry to the cabinet interior as by curious infants or youngsters.

2 Claims, 3 Drawing Figures

Fig. 1.
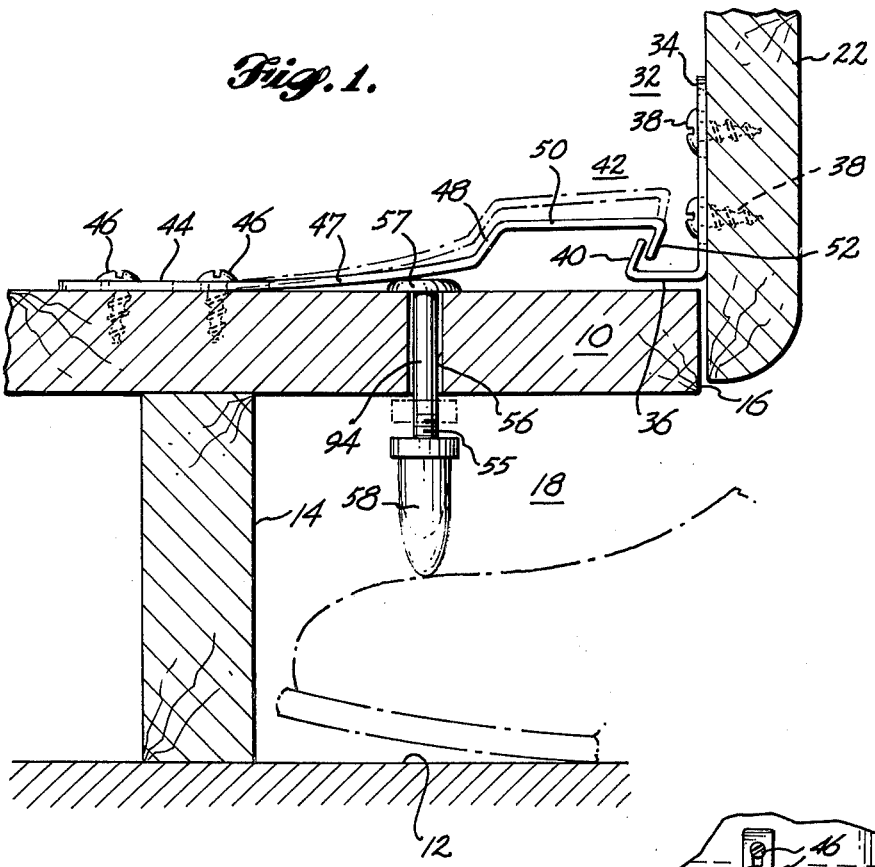
Fig. 2.
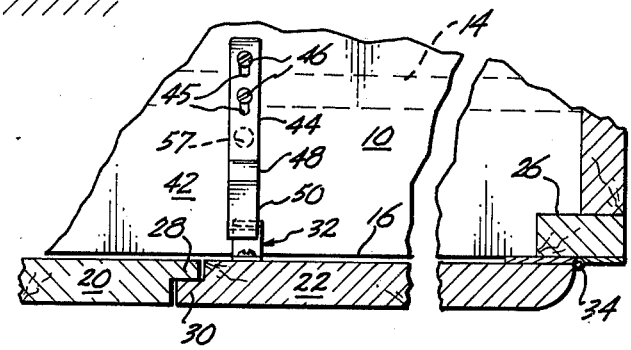
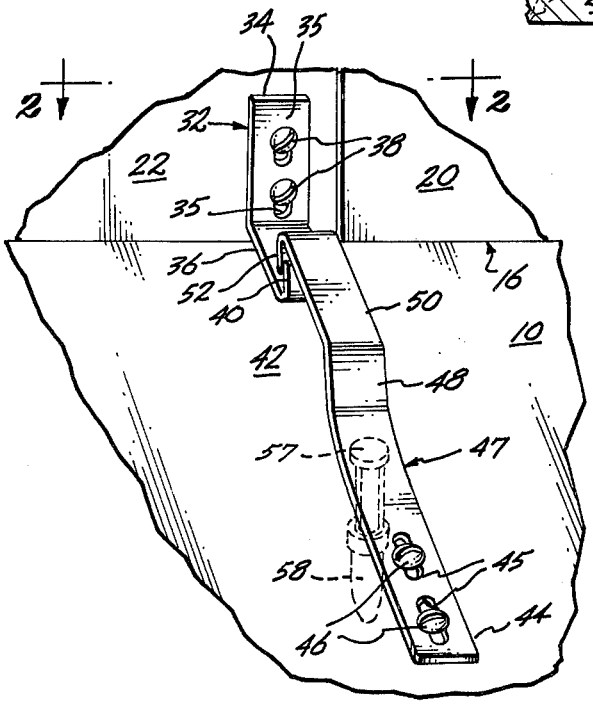
Fig. 3.

OBSCURELY LATCHED CLOSURES FOR CABINETS

SUMMARY OF THE INVENTION

This invention relates to a cabinet-door latch device that is mounted within a cabinet and has an operator element readily accessible to an adult but which is practically concealed and not readily discoverable or easily operable as by the inexperienced infants and the like.

The invention is particularly applicable for use in connection with kitchen and bathroom-type cabinets of the nature commonly used beneath sinks, washbasins or counters. It is common practice for the housewife or others to store in such cabinets cleaning and sanitizing compounds and materials, waste disposal containers, and often, dangerous or harmful chemical materials that should be maintained inaccessible to the crawling infant or toddler having a curious bent. It is also common practice to latch such closure doors or cabinets by the use of magnetic catches, spring detent catches or easily manipulated, manually operated catches, the door normally being drawn open by a handle or other means conveniently located near its upper portion. Such catches and latches are natural objects of curiosity on the part of infants and youngsters who readily acquire the facility of opening the cabinet doors and then proceed to prowl through the contents, often to their harm and invariably to the despair of the parent.

An important object of this invention is to provide a sealed latching mechanism that is mounted within the cabinet and has an operator element which is practically concealed from those it is desired to exclude from the cabinet. It is a further object of this invention to mount the operative element in the kick-space at the lower portion of the cabinet where it is easily accessible to a knowing adult and its operation is not readily apparent to an infant or toddler. A still further object of this invention is to provide a mechanism involving spring means which may be easily worked by the toe of an adult inserted into the kick space, but which has a degree of resistance and is so inaccessible as to not be manually manipulated by a small person. Further objects and advantages of this invention will become apparent during the course of the following specification and with reference to the accompanying drawing.

DESCRIPTION OF THE DRAWINGS

FIG. 1 is a fragmentary, vertical cross-sectional view of a cabinet portion embodying this invention;

FIG. 2 is a horizontal cross-sectional view of a cabinet front, in the plane 2—2 of FIG. 3, showing this invention; and FIG. 3 is a perspective view of the striker/catch mechanism forming the latching part of the inventive subject matter.

DESCRIPTION OF THE INVENTION

Referring to the drawings, wherein is shown pertinent portions of a conventional cabinet as is commonly used in kitchens, bathrooms and the like, horizontal bottom shelf 10 overlies floor 12 in vertical spaced juxtaposition. Shelf 10 usually rests on a supporting stringer 14 disposed inward of the shelf front edge 16. The underside of shelf 10 and stringer 14 forms with the floor 12, the kick-space 18.

Door panels 20, 22 usually pivotally mounted at their side edges as on hinges 24, close against the front edge 16 of shelf 10 as best seen in FIG. 1. Hinges 24 are usually mounted on stiles 26 which are part of the cabinet structure. In this exemplary showing doors 20, 22 are provided at their abutting free edges with interfitting tongues 28, 30.

Door panel 22 on its inner face receives and supports an L-shaped strike device 32 which comprises attaching arm 34 and instanding arm 36. Arm 34 is pierced by holes 35 to receive screws 38 which secure the arm to the inner face of the door 22. Instanding arm 36 enters the cabinet space and closely overlies the upper surface of shelf 10. An upstanding catch or flange 40 on the inner end of arm 36 is thus positioned to be engaged for latching purposes. Preferably catch 40 is disposed at an acute angle to arm 36.

The latching mechanism 42 comprises flexible tang 44 which is pierced at 45 to receive screws 46 that secure it to the upper surface of shelf 10 inward of front edge 16. Extending forwardly of tang 44 is riser 48 and latch arm 50 which terminates with downstanding jaw latch 52. Latching mechanism 42 is formed of a continuous strip of springy material biased downward. Latch 52 is disposed at an acute angle to arm 50. It resides in the path of arm 36 as the latter enters the cabinet, as when door 22 is closing. Under such circumstances the leading face of catch 40 engages the front face of latch 52, a wedging action occurs, and arm 50 is displaced upward as indicated in the dotted lines in FIG. 1. Catch 40 passes under latch 52, whereupon the biased arm 50 returns downward and the parts engage to secure door 22 in the enclosed position.

The unlatching mechanism is unobviously located in shelf 10 and in kick-space 18. It comprises push pin 94 slideably mounted in upright hole 56 in shelf 10. Head 57 on the upper end of pin 94 spans hole 56 and underlies the forward unattached, flexible portion 47 of tang 44. The lower end of pin 94 is threaded at 55 to receive knob 58 or button 58a that depends into space 18. It will be observed that the full force of the downwardly biased latching mechanism 42 presses on pin 94. This flexible force must be overcome to accomplish disengagement of latch 52 from catch 40.

Raising of pin 94 by an adult using the toe, as is suggested in FIG. 1, is no difficult feat. However, the accomplishment of the same by an infant or young child is virtually precluded. Experience shows that the obscure location of the operative member 58 in kick-space 18 and its unapparent relation to the door-opening operation presents, even to the most precocious child, a practically insoluable problem.

In FIGS. 2 and 3 a single latching mechanism 42 is shown to secure an interfitted pair of cabinet doors. It should be apparent that such latching mechanism may be used on a single door, or that an edge-abutting pair of non-interfitted doors may be secured by its own latching mechanism 42.

In compliance with the statute, the invention has been described in language more or less specific as to structural features. It is to be understood, however, that the invention is not limited to the specific features shown, since the means and construction herein disclosed comprises a preferred form of putting the invention into effect. The invention is, therefore, claimed in any of its forms or modifications within the legitimate and valid scope of the appended claims, appropriately interpreted in accordance with the doctrine of equivalents.

What is claimed is:

1. In a cabinet or the like having a kick-space beneath the front edge of the bottom shelf and a latched door panel normally closing to said bottom shelf, the latching of said door panel being accomplished by an instanding strike device strike device having an upstanding catch located to overlie the bottom shelf when the door is closed and there is an elongated latching mechanism comprising a tang secured to the upper face of said shelf and having a downwardly biased flexible arm supporting a downstanding jaw latch located to engage said catch to retain said door closed against said shelf edge, the improvement comprising:

a lifter pin slideably mounted upright in said shelf and being of a length to depend into said kick space in a normally unobvious manner, the lower end of said pin being located to be readily accessible to a user's toe applied in an upward direction to its lower extremity;

said lifter pin having a head on its upper end limiting downward travel and being located beneath said flexible arm for upward movement against the bias of said arm to cause disengagement of said downstanding jaw latch from said catch.

2. The structure according to claim 1 in which the lower extremity of the depending pin has an enlarged knob located to limit upward travel.

* * * * *